United States Patent [19]

Lewis, Sr.

[11] Patent Number: 5,012,543

[45] Date of Patent: May 7, 1991

[54] ATHLETIC TOWEL

[76] Inventor: John Lewis, Sr., 7621 Gleason Rd., Houston, Tex. 77016

[21] Appl. No.: 381,809

[22] Filed: Jul. 19, 1989

[51] Int. Cl.[5] ..... A41D 27/00

[52] U.S. Cl. ..... 15/209 R; 15/210 R; 2/279

[58] Field of Search ..... 15/209 R, 210 R; 2/48, 2/47, 46, 311, 312, 279; 224/253, 901, 224

[56] References Cited

U.S. PATENT DOCUMENTS

| | | | |
|---|---|---|---|
| 2,988,745 | 6/1961 | Whitley et al. | 2/48 |
| 3,115,639 | 12/1963 | Moszczynski | 2/48 |
| 3,760,461 | 9/1973 | Wright | 15/209 R |
| 4,119,249 | 10/1978 | Hanson | 224/901 |
| 4,403,366 | 9/1983 | Lucke | 15/209 R |
| 4,771,502 | 9/1988 | Trimble | 15/209 R |

*Primary Examiner*—Harvey C. Hornsby
*Assistant Examiner*—Gary K. Graham
*Attorney, Agent, or Firm*—Jerry T. Kearns

[57] ABSTRACT

An athletic towel is formed from an elongated generally rectangular piece of a terry cloth fabric material. An elongated strap is secured across a central portion of the fabric piece. Free ends of the strap have cooperating hook and loop fasteners for securement around an individual's waist. A pocket on the fabric piece includes cooperating hook and loop fasteners for securing the pocket in a closed position to carry various accessory items. Safety indicia may be provided on the fabric piece for warning motorists and bicyclists of a jogger's presence. The athletic towel is designed for use by joggers and provides a towel for wiping perspiration which includes a pocket for carrying accessory items such as keys.

1 Claim, 3 Drawing Sheets

ATHLETIC TOWEL

BACKGROUND OF THE INVENTION

1. Field of the Invention

The present invention relates to towels, and more particularly pertains to a new and improved athletic towel for use by joggers. Many joggers are forced to carry towels in their hand or tucked into the waistband of their jogging shorts in order to be able to conveniently wipe perspiration from their face. Additionally, it is uncomfortable for joggers to carry bulky items such as wallets and keys in the pocket of their jogging shorts. Indeed, most jogging shorts do not even have a pocket. In order to overcome these problems, the present invention provides a towel which includes a pocket for transporting accessory items and an elongated strap for securement around an individual's waist.

2. Description of the Prior Art

Various types of towels are known in the prior art. A typical example of such a towel is to be found in U.S. Pat. No. 2,344,010, which issued to H. Walsh on Mar. 14, 1944. This patent discloses a beach towel which includes a draw string type closure to enable the towel to also be used as a receptacle. U.S. Pat. No. 2,754,532, which issued to L. Kanehl et al on July 17, 1956, discloses a sportsman's towel having a snap secured fastening strip adapted for securement around the belt of an individual. U.S. Pat. No. 4,224,712, which issued to H. Black et al on Sept. 30, 1980, discloses a towel adapted to be worn by a football player during a game. The towel includes an elongated rectangular stub portion adapted for securement in the waistband of an athlete's pants. U.S. Pat. No. 4,516,616, which issued to E. Fesler on May 14, 1985, discloses a cover for a towel formed from a sheet of water proof material. A ball chain is secured through eyelets in the cover and the towel for securing the towel assembly to a golf bag. U.S. Pat. No. 4,656,670, which issued to H. Schluter on Apr. 14, 1987, discloses a combined beach towel and robe having a releasable securing flap for closing the head opening of the robe. A pocket is provided at one end of the towel to facilitate use of the towel as a car seat cover and to also provide a pocket for use when the beach towel is used as a robe.

While the above mentioned devices are directed to towels, none of these devices disclose an athletic towel suitable for use by joggers which includes an elongated strap having cooperating hook and loop fasteners for securement around the waist of an individual. Additionally, none of the aforesaid towels disclose the provision of safety indicia to warn motorists and bicyclists about a jogger's presence. Inasmuch as the art is relatively crowded with respect to these various types of towels, it can be appreciated that there is a continuing need for and interest in improvements to such towels, and in this respect, the present invention addresses this need and interest.

SUMMARY OF THE INVENTION

In view of the foregoing disadvantages inherent in the known types of towels now present in the prior art, the present invention provides an improved athletic towel. As such, the general purpose of the present invention, which will be described subsequently in greater detail, is to provide a new and improved athletic towel which has all the advantages of the prior art towels and none of the disadvantages.

To attain this, representative embodiments of the concepts of the present invention are illustrated in the drawings and make use of an athletic towel which is formed from an elongated generally rectangular piece of a terry cloth fabric material. An elongated strap is secured across a central portion of the fabric piece. Free ends of the strap have cooperating hook and loop fasteners for securement around an individual's waist. A pocket on the fabric piece includes cooperating hook and loop fasteners for securing the pocket in a closed position to carry various accessory items. Safety indicia may be provided on the fabric piece for warning motorists and bicyclists of a jogger's presence. The athletic towel is designed for use by joggers and provides a towel for wiping perspiration which includes a pocket for carrying accessory items such as keys.

There has thus been outlined, rather broadlY, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting. As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseologY, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved athletic towel which has all the advantages of the prior art towels and none of the disadvantages.

It is another object of the present invention to provide a new and improved athletic towel which may be easily and efficiently manufactured and marketed.

It is a further object of the present invention to provide a new and improved athletic towel which is of a durable and reliable construction.

An even further object of the present invention is to provide a new and improved athletic towel which is susceptible of a low cost of manufacture with regard to both materials and labor, and WhiCh accordingly is then susceptible of low prices of sale to the consuming public, thereby making such towels economically available to the buying public.

Still yet another object of the present invention is to provide a new and improved athletic towel which provides in the apparatuses and methods of the prior art some of the advantages thereof, while simultaneously overcoming some of the disadvantages normally associated therewith.

Still another object of the present invention is to provide a new and improved athletic towel to enable joggers to conveniently wipe perspiration during running.

Yet another object of the present invention is to provide a new and improved athletic towel including a pocket enabling joggers to conveniently transport various accessory items.

Even still another object of the present invention is to provide a new and improved athletic towel including indicia providing a warning of a jogger's presence to motorists and bicyclists.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
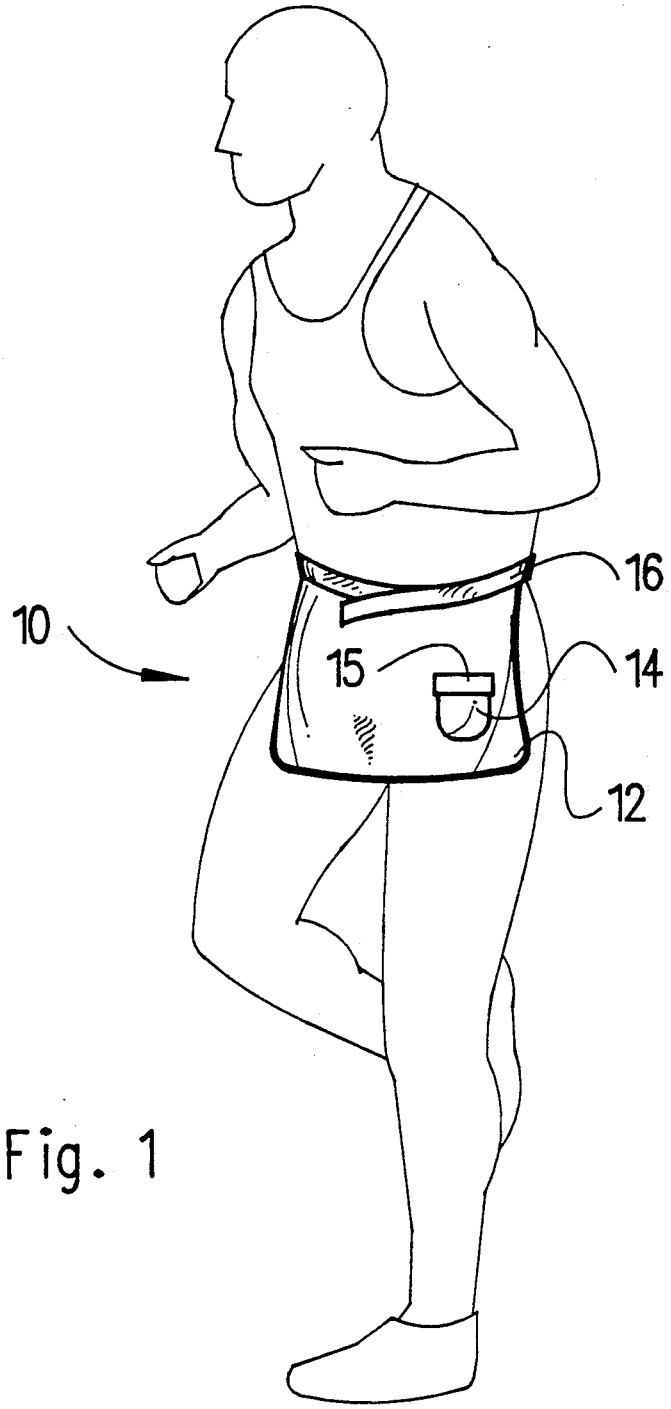
FIG. 1 is a diagrammatic view illustrating the athletic towel of the present invention as worn bY a jogger.

With reference now to the drawings, and in particular to FIG. 1 thereof, a new and improved athletic towel embodying the principles and concepts of the present invention and generally designated by the reference numeral 10 will be described.

More specifically, it will be noted that the first embodiment 10 of the invention includes an elongated generally rectangular fabric piece 12, preferably formed from a terry cloth material. A pocket 14 provided on the fabric piece 12 includes a securing flap 15 for securing the pocket 14 in a closed position to carry various accessory items such as keys and wallets. An elongated strap 16 is secured to the fabric piece 12 and is dimensioned for securement around the waist of an individual. As shown, the towel 10 may be oriented to the front of the individual, with the pocket 14 in an exposed accessible position.

Alternatively, the towel 14 may be oriented in a rearwardly facing position, depending upon the preferences of a user.

Figure 3:
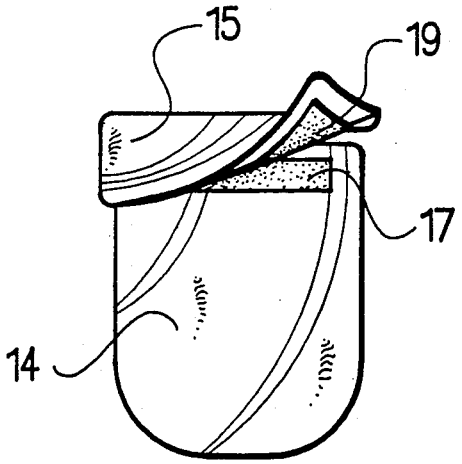
FIG. 3 is a detail view which illustrates the pocket of the towel utilized to transport various accessory items.

As shown in FIG. 3, the pocket 14 includes a first hook and loop type fastening members 17 adapted for engagement with a cooperating hook and loop type fastening member 19 provided on a securement flap 15. The securement flap 15 prevents the loss of any items transported within the pocket 14. The hook and loop type fastening members 17 and 19 may be of the type sold under the trademark VELCRO.

Figure 4:
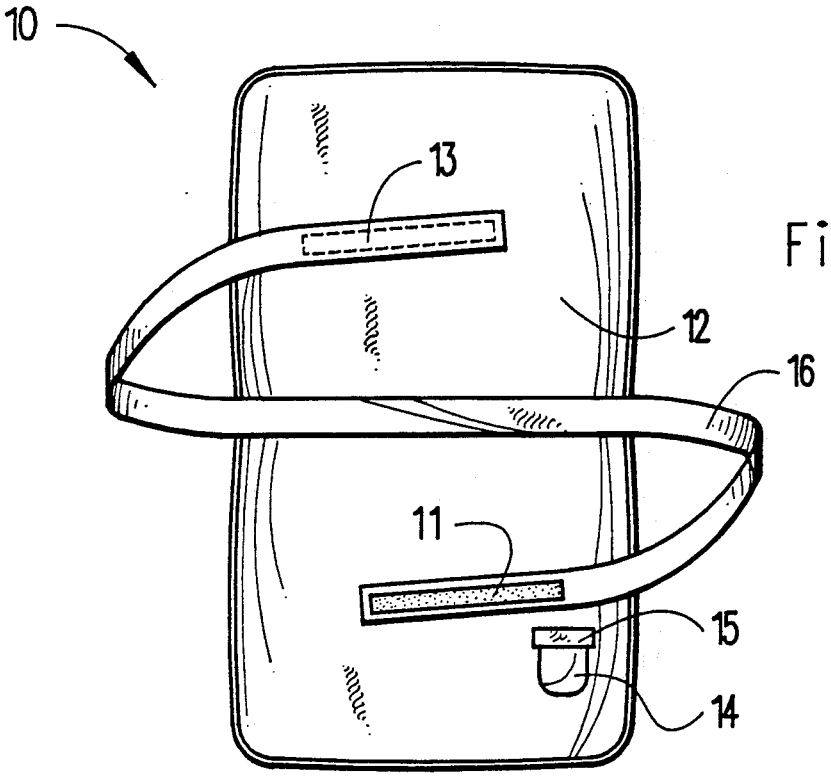
FIG. 4 illustrates the towel of the invention folded to an open flat position.

FIG. 4 illustrates the athletic towel 10, with the elongated generally rectangular fabric piece 12 folded to a flat position. An elongated fabric strap 16, also preferably formed from a terry cloth material, is secured across a central portion of the fabric piece 12, and extends across the width thereof. The strap 16 has opposite free ends provided with cooperating hook and loop type fastening members 11 and 13 adapted for engagement around the waist of a user. The fasteners 11 and 13 are sufficiently elongated to afford a substantial range of adjustment to enable use by various individuals. In use, the fabric piece 12 is folded approximately in half along the line of the strap 16. The towel 10 allows individuals to have convenient access to a towel for wiping perspiration and also allows accessory items such as keys and wallets to be carried in the pocket 14.

Figure 2:
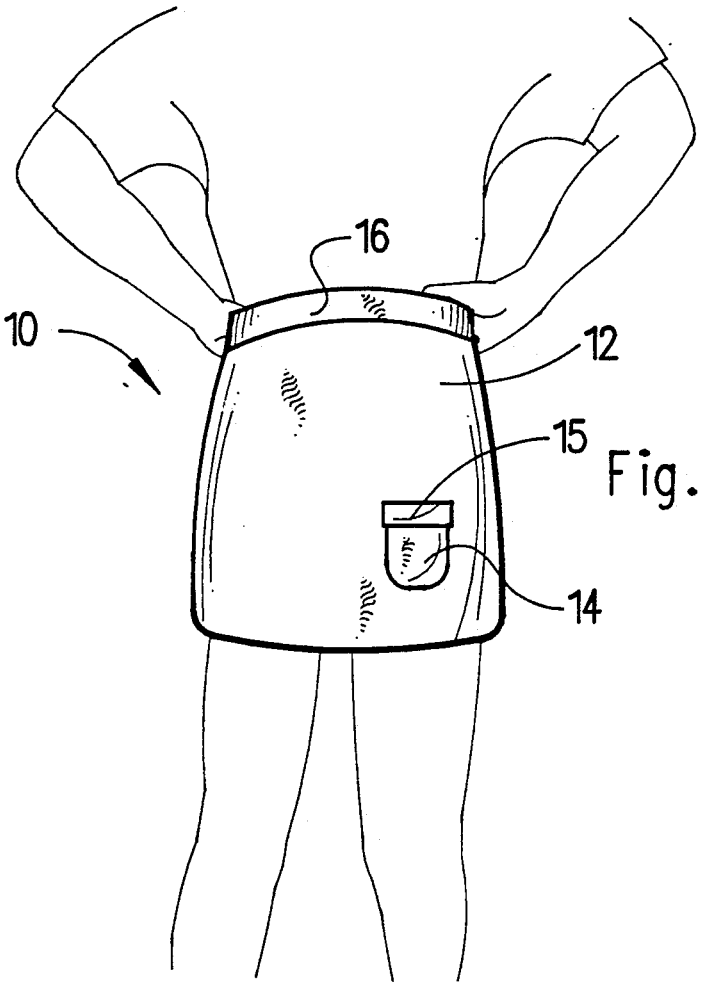
FIG. 2 illustrates the athletic towel of the present invention being worn in an optional rearwardly facing position.
Figure 5:
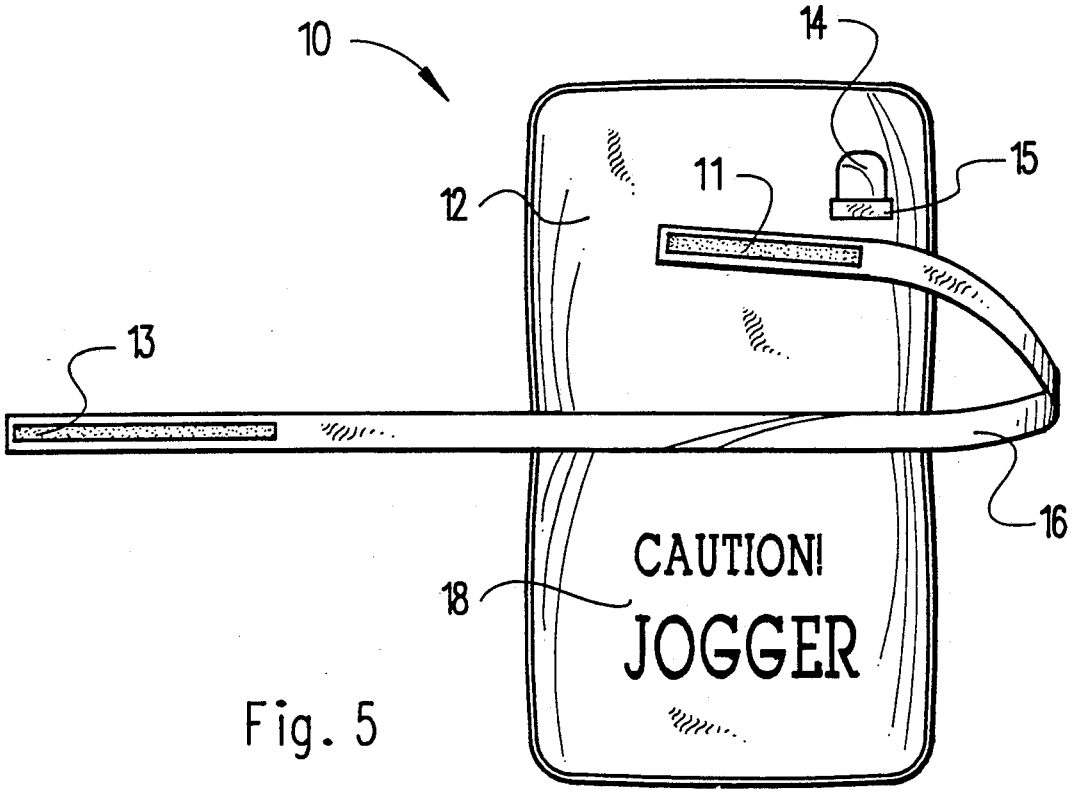
FIG. 5 illustrates a towel according to a second embodiment of the present invention which is provided with safety warning indicia.

FIG. 5 illustrates an alternative embodiment 10' in which safety indicia 18 is provided on one of the two rectangular zones formed by the strap 16. In use, the fabric piece 12 is folded to expose the indicia 18 and the towel 10' is then worn in the rearward facing orientation illustrated in FIG. 2. It is contemplated that the safety indicia 18 will be formed from a highly reflective material to increase a jogger's safety at night and in other dim light conditions.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. An athletic towel, comprising:

an elongated generally rectangular fabric piece formed from an absorbent cloth material;

an elongated strap secured across a central portion of said fabric piece, said strap dividing said fabric piece into two substantially equal sized rectangular portions, said substantially equal sized rectangular portions folded in overlying relation along said strap;

cooperating hook and loop fasteners on opposite free ends of said strap for securement around an individual's waist;

at least one pocket on one of said rectangular portions of said fabric piece for carrying accessory items, said pocket disposed so as to face the body of a wearing individual so as to be hidden from view;

a flap closing said pocket and cooperating hook and loop fasteners on said pocket and flap for securing said pocket in a closed position; and reflective indicia on the other one of said rectangular portions of said fabric piece providing a safety warning.

* * * * *